US005148724A

United States Patent [19]

Rexford

[11] Patent Number: 5,148,724

[45] Date of Patent: Sep. 22, 1992

[54] RATCHET WRENCH AND SOCKET APPARATUS

[76] Inventor: Gary R. Rexford, 76 Mechanic St., Lancaster, N.H. 03584

[21] Appl. No.: 714,504

[22] Filed: Jun. 13, 1991

[51] Int. Cl.[5] ..... B25B 13/46

[52] U.S. Cl. ..... 81/60; 81/124.4; 81/177.4; 81/490

[58] Field of Search ..... 81/124.4, 177.4, 490, 81/60

[56] References Cited

U.S. PATENT DOCUMENTS

| | | | |
|---|---|---|---|
| 1,171,063 | 2/1916 | Nigborowicz | 81/177.4 X |
| 4,627,315 | 12/1986 | Lin | 81/490 X |
| 4,926,721 | 5/1990 | Hsiao | 81/177.4 |
| 5,048,379 | 9/1991 | Gramera et al. | 81/124.4 |

FOREIGN PATENT DOCUMENTS

| | | | |
|---|---|---|---|
| 735672 | 6/1966 | Canada | 81/124.4 |
| 2462971 | 3/1981 | France | 81/124.4 |

*Primary Examiner*—James G. Smith
*Attorney, Agent, or Firm*—Leon Gilden

[57] ABSTRACT

A plurality of sockets are provided, wherein each socket is coaxially aligned and includes a first and second polygonal cavity directed interiorly and longitudinally of the socket from each opposed terminal end thereof. A socket member web is orthogonally oriented relative to an axis defined by the socket member and is positioned medially of the axial length defined by the socket member. The web includes a polygonal cavity coaxially therethrough to receive a forward extension of an extension leg. Alternatively, the ratchet wrench member may include an elongated output drive shaft for reception within the polygonal cavity of the socket member web. An adapter arrangement is provided for use with an output drive shaft of conventional length, wherein the adapter member is received within a tubular cavity of the ratchet wrench handle.

3 Claims, 3 Drawing Sheets

EQUIVALENCY TABLE

| U.S. (INCHES) | METRIC (MM) |
|---|---|
| 5/16 | 8 |
| 3/8 | 10 |
| 7/16 | 11 |
| 1/2 | 13 |
| 9/16 | 15 |
| 5/8 | 16 |
| 11/16 | 18 |
| 3/4 | 19 |
| 13/16 | 21 |
| 7/8 | 22 |

RATCHET WRENCH AND SOCKET APPARATUS

BACKGROUND OF THE INVENTION

1. Field of the Invention

The field of invention relates to tool apparatus, and more particularly pertains to a new and improved ratchet wrench and socket apparatus wherein the same utilizes an array of socket members of opposed polygonal cavities of standard and metric configurations respectively to accommodate standard and metric fasteners of various types.

2. Description of the Prior Art

The advent of metric fasteners in combination with standard fasteners in automotive environments for example provides confusion and duplication of tools in accommodating of such fasteners. The instant invention sets forth an organization wherein socket wrench structure is provided to accommodate both metric and standard fasteners minimizing tool duplication.

Examples of prior art socket structure is exemplified in U.S. Pat. No. 1,458,956 to Sayer wherein a socket wrench includes a through-extending bore formed with a polygonal cavity for receiving a fastener therewithin.

U.S. Pat. No. 4,939,960 to Kinzli sets forth a wrench structure wherein the structure includes a plurality of sockets formed at opposed terminal ends of elongate shafts.

U.S. Pat. No. 4,459,716 to Valadez sets forth a socket wrench structure utilizing cavities coextensively directed through the socket wrench of increasing dimensions.

As such, it may be appreciated that there continues to be a need for a new and improved ratchet wrench and socket apparatus as set forth by the instant invention which addresses both the problems of ease of use as well as effectiveness in construction in accommodating fasteners of metric and standard configurations and in this respect, the present invention substantially fulfills this need.

SUMMARY OF THE INVENTION

In view of the foregoing disadvantages inherent in the known types of tool apparatus now present in the prior art, the present invention provides a ratchet wrench and socket apparatus wherein the same sets forth a plurality of sockets, each of opposed metric and standard configurational cavities to accommodate metric and standard fasteners. As such, the general purpose of the present invention, which will be described subsequently in greater detail, is to provide a new and improved ratchet wrench and socket apparatus which has all the advantages of the prior art tool apparatus and none of the disadvantages.

To attain this, the present invention provides a plurality of sockets wherein each socket is coaxially aligned and includes a first and second polygonal cavity directed interiorly and longitudinally of the socket from each opposed terminal end thereof. A socket member web is orthogonally oriented relative to an axis defined by the socket member and is positioned medially of the axial length defined by the socket member. The web includes a polygonal cavity coaxially therethrough to receive a forward extension of an extension leg. Alternatively, the ratchet wrench member may include an elongated output drive shaft for reception within the polygonal cavity of the socket member web. An adapter arrangement is provided for use with an output drive shaft of conventional length, wherein the adapter member is received within a tubular cavity of the ratchet wrench handle.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ratchet wrench and socket apparatus which has all the advantages of the prior art tool apparatus and none of the disadvantages.

It is another object of the present invention to provide a new and improved ratchet wrench and socket apparatus which may be easily and efficiently manufactured and marketed.

It is a further object of the present invention to provide a new and improved ratchet wrench and socket apparatus which is of a durable and reliable construction.

An even further object of the present invention is to provide a new and improved ratchet wrench and socket apparatus which is susceptible of a low cost of manufacture with regard to both materials and labor, and which accordingly is then susceptible of low prices of sale to the consuming public, thereby making such ratchet wrench and socket apparatus economically available to the buying public.

Still yet another object of the present invention is to provide a new and improved ratchet wrench and socket apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
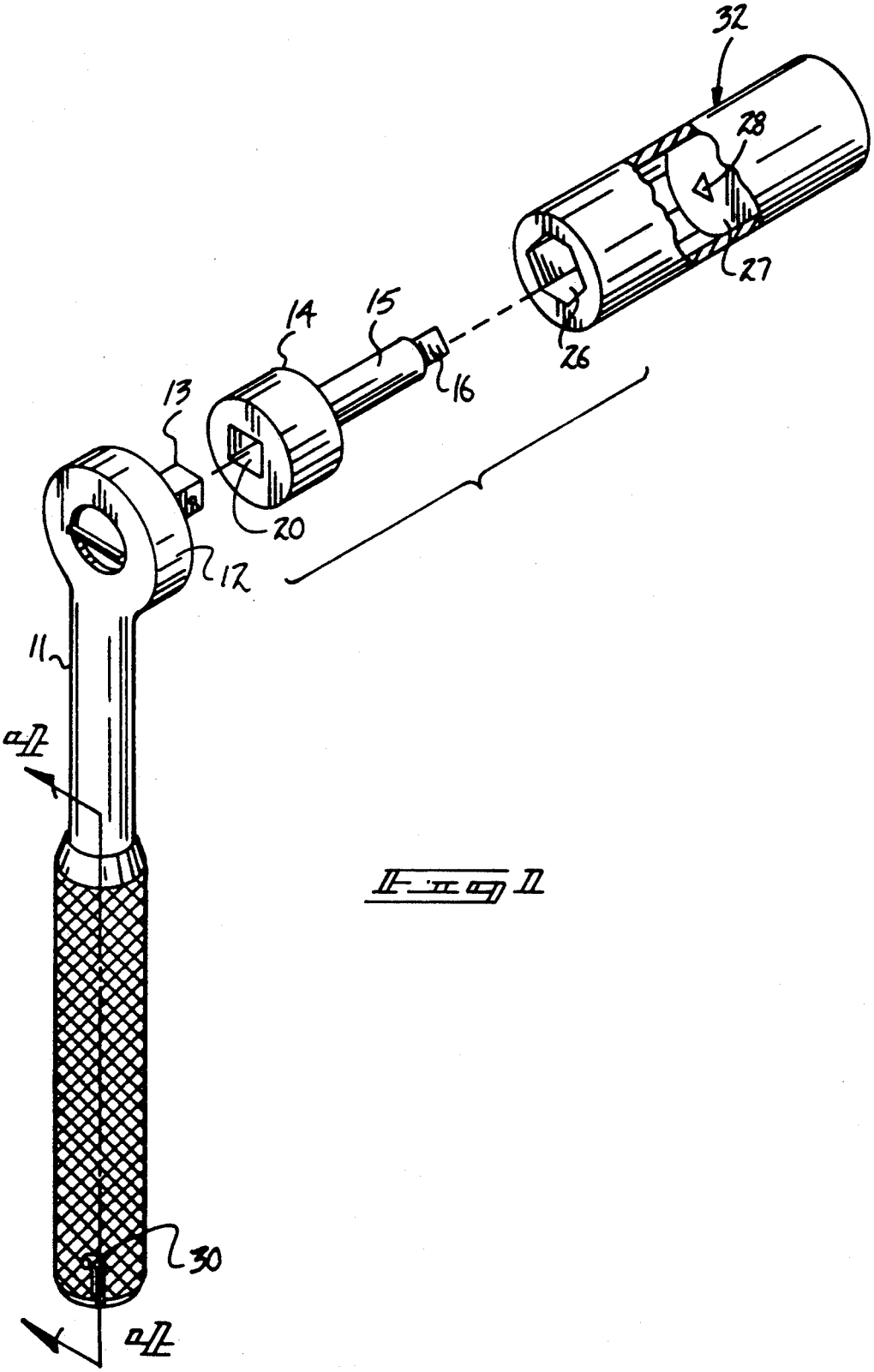
FIG. 1 is an isometric illustration of the instant invention.

With reference now to the drawings, and in particular to FIGS. 1 to 5 thereof, a new and improved ratchet wrench and socket apparatus embodying the principles and concepts of the present invention and generally designated by the reference numeral 10 will be described.

More specifically, the ratchet wrench and socket apparatus 10 of the instant invention essentially comprises a ratchet wrench member, including a longitudinally aligned handle 11 mounting a ratchet head 12 thereon. The ratchet head 12 includes a ratchet drive shaft 13. An extension adapter 14 is provided for securement to an extension leg 15. The extension leg 15 includes the extension leg forward polygonal end 16 defined by a predetermined first cross-sectional configuration and an extension leg rear polygonal end 17 at an opposed end of the leg 15 defined by a predetermined second cross-sectional configuration. The extension adapter 14 includes diametrically opposed and aligned legs 18 for securement of the adapter 14 within the rear terminal end of the tubular handle 11 that includes a handle cavity 31. Diametrical handle legs 18 are received within diametrically opposed "L" shaped grooves 30 formed within the handle cavity 31 extending from the rear terminal end of the handle 11 longitudinally thereof.

The extension adapter 14 includes an adapter first cavity 20 that is coaxially directed through the adapter 14 and aligned with an adapter second cavity 19 that is coaxially aligned with the first cavity 20, and is defined by the predetermined second configuration to receive the extension leg rear polygonal end 17 therewithin.

Figures 2, 3:
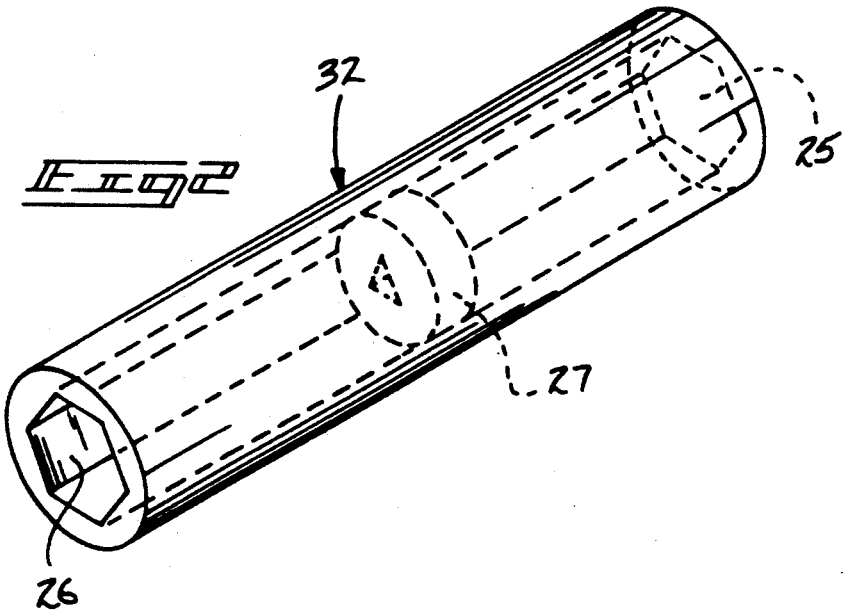
FIG. 2 is an isometric illustration of a typical socket wrench utilized by the instant invention.
FIG. 3 is a diagrammatic presentation of equivalency of each of the sockets contemplated to include a standard and metric dimension directed into opposed ends of the socket, as typified in FIG. 2.
Figure 5:
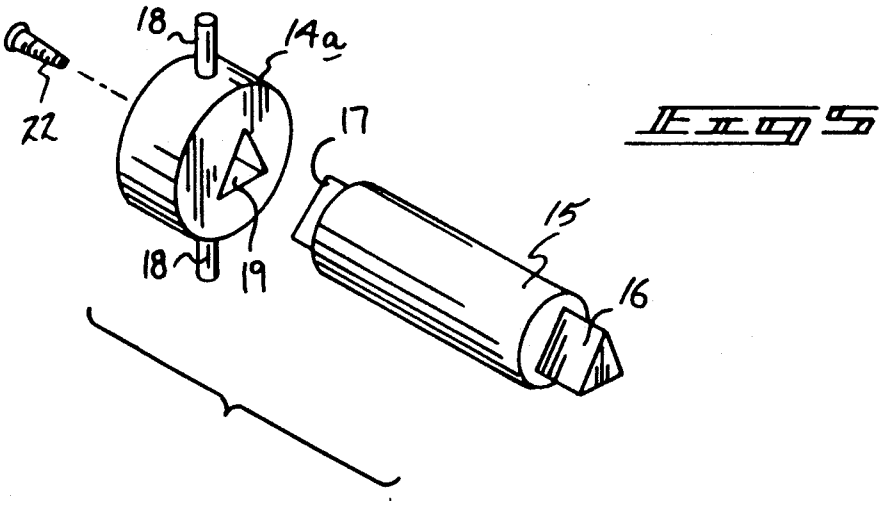
FIG. 5 is an isometric exploded illustration of the adapter structure contemplated for use by the instant invention.
Figure 4:
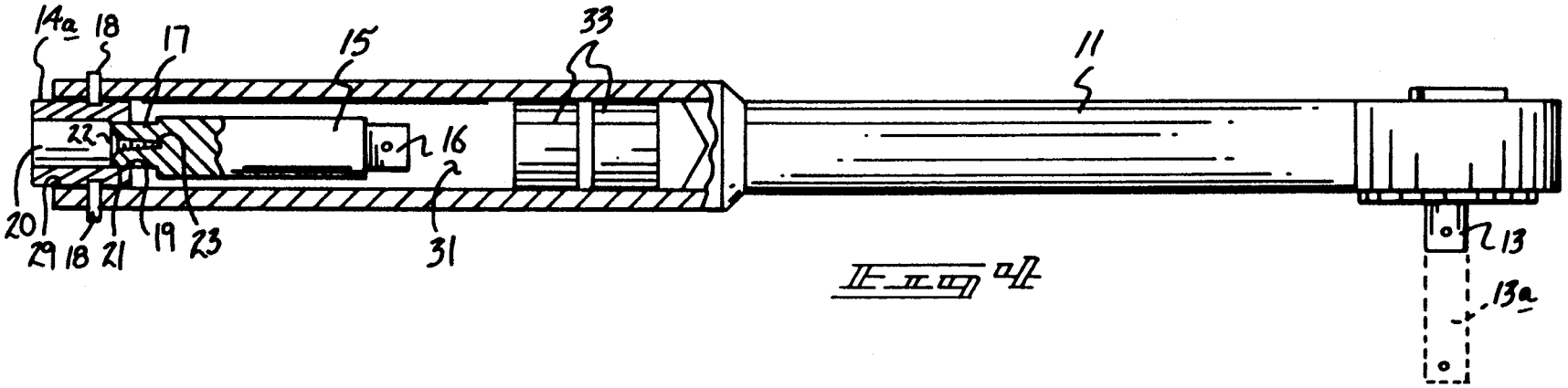
FIG. 4 is an orthographic view, taken along the lines 4—4 of FIG. 1 in the direction indicated by the arrows.

It is understood that a ratchet wrench member may utilize an elongated output drive shaft 13 of a length substantially greater than one-half of a predetermined axial length of an associated socket member 32, such as illustrated in FIG. 2. Such an elongate extension is illustrated in phantom in FIG. 4 for example. While this embodiment may be utilized, the adapter construction of the instant invention permits utilization of a standard length output drive shaft 13, as opposed to the extended length shaft 13*a*.

A series of socket members are utilized wherein the socket members are of tubular construction and include a first socket member polygonal cavity 25 coaxially aligned with a second socket member polygonal cavity 26 that are directed coaxially and interiorly of the socket member from opposed first and second respective ends of the socket member 32. The respective first and second polygonal cavities 25 and 26 utilize respective standard and metric socket cross-sectional configurations to accommodate standard and metric fasteners minimizing a need for duplication of tools, and whereby each socket member 32 of a series of socket members are equivalent of two ordinary sockets. Each socket member includes a socket member web 27 orthogonally oriented relative to an axis defined by the socket member 32 that is coaxially oriented relative to the first and second polygonal cavities 25 and 26 positioned medially of a predetermined axial length defined by the socket member 32. The web 27 includes a web cavity 28 defined by the predetermined first cross-sectional configuration to receive the extension leg forward polygonal end 16 therewithin. The web cavity 28 extends in a through-extending coaxially aligned manner relative to the web 27 to permit acceptance of the extension leg forward polygonal end 16 through each of the first and second polygonal cavities 25 and 26. In storage of the organization, the adapter 14 is positioned within the entrance 29 of the handle cavity 31, wherein the "L" shaped grooves 30 originate at the entrance cavity 29. Further, a web screw 22 is directed through the adapter first cavity 20 and captured by an adapter web 21 that defines an innerface between the adapter first and second cavities 20 and 19. The screw 22 extends into a rear polygonal end bore 23 within the extension leg rear polygonal end 17 to thereby secure in a stable manner the organization within the handle cavity 31. Counterweights 33 are positioned within the cavity at a forward terminal end thereof to provide balance in use of the ratchet wrench to compensate for lighter than normal weight handle construction, wherein the counterweights 33 are of a denser metal than that of the handle 11, such as lead and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ratchet wrench and socket apparatus, comprising in combination, a ratchet wrench including an elongate handle, the handle mounting a ratchet wrench head at a forward terminal end of the handle, and the head including an output drive shaft orthogonally oriented and directed exteriorly of the head, and at lest one socket member, the socket member defined by an elongate coaxially aligned configuration defined by a predetermined axial length, the socket member including a socket member first end and a socket member second end, the socket member first end including a first polygonal cavity directed longitudinally of the socket member interiorly thereof, and the socket member further including a second polygonal cavity coaxially aligned with the first polygonal cavity extending from the socket member second end interiorly thereof, and a socket member web orthogonally oriented relative to the axis of the socket member and positioned medially thereof, including a through-extending web cavity defined by a predetermined first cross-sectional configuration, and an extension adapter, the extension adapter including an adapter first cavity defined by a predetermined first cross-sectional configuration, and an adapter second cavity, the adapter second cavity defined by a predetermined second cross-sectional configuration, the extension adapter including a central leg, with the central leg including a leg forward polygonal end defined by the predetermined first cross-sectional configuration, and a leg rear polygonal end defined by the predetermined second cross-sectional configuration, wherein the leg rear polygonal end is arranged for reception within the adapter second cavity, and the leg forward polygonal end is arranged for reception within the web cavity, and the handle includes an elongate handle cavity defined by a cavity entrance, and the extension adapter is arranged for reception within the cavity entrance, and the extension adapter includes a plurality of diametrically opposed and aligned legs, and the handle including a plurality of diametrically opposed L-shaped grooves originating at the cavity entrance for reception of the legs.

2. An apparatus as set forth in claim 1 wherein the adapter includes an adapter web innerfacing between the adapter first cavity and the adapter second cavity, and a web screw directed through the adapter web extending beyond the adapter and through the second cavity, and the extension leg rear polygonal end including a rear polygonal end bore coaxially directed through the extension leg rear polygonal end receiving the web screw therewithin for securement of the extension adapter to the extension leg.

3. An apparatus as set forth in claim 2 including at least one counter-weight contained within the handle cavity, wherein the counter-weights are defined by a predetermined first density, and the handle is defined by a predetermined second density, wherein the predetermined first density is greater than the predetermined second density.

* * * * *